US005613931A

United States Patent [19]

Maty

[11] Patent Number: 5,613,931

[45] Date of Patent: Mar. 25, 1997

[54] SEGMENTED END BELL

[75] Inventor: David J. Maty, Ontario, N.Y.

[73] Assignee: Xerox Corporation, Stamford, Conn.

[21] Appl. No.: 358,436

[22] Filed: Dec. 19, 1994

[51] Int. Cl.[6] ..... G03G 21/00

[52] U.S. Cl. ..... 492/47; 29/451; 29/521

[58] Field of Search ..... 29/521, 895, 451; 492/42, 45, 27, 47; 355/210, 211, 212

[56] References Cited

U.S. PATENT DOCUMENTS

| | | | |
|---|---|---|---|
| 2,647,299 | 8/1953 | Thomas | 492/47 |
| 2,747,210 | 5/1956 | Canning et al. | 492/47 |
| 2,747,211 | 5/1956 | Touchett | 492/47 |
| 3,169,020 | 2/1965 | Smith | 29/451 |
| 3,738,264 | 6/1973 | Sobottka et al. | 101/110 |
| 3,994,053 | 11/1976 | Hunt | 29/123 |
| 4,040,157 | 8/1977 | Shanly | 29/123 |
| 4,105,345 | 8/1978 | VanWagner | 403/24 |
| 4,120,576 | 10/1978 | Babish | 355/3 DR |
| 4,400,077 | 8/1983 | Kozuka et al. | 355/3 DR |
| 4,561,763 | 12/1985 | Basch | 492/42 |
| 4,621,919 | 11/1986 | Nitanda et al. | 355/3 DR |
| 4,878,085 | 10/1989 | Ward et al. | 355/47 |
| 4,921,288 | 5/1990 | Cifuentes et al. | 292/144 |
| 4,940,937 | 7/1990 | Hattori | 29/521 |
| 4,975,743 | 12/1990 | Surti | 355/211 |
| 5,151,737 | 9/1992 | Johnson et al. | 355/211 |
| 5,210,574 | 5/1993 | Kita | 355/211 |
| 5,357,321 | 10/1994 | Stenzel et al. | 355/211 |

*Primary Examiner*—Larry I. Schwartz
*Assistant Examiner*—Marc W. Butler

[57] ABSTRACT

A tapered pot-like hub is disclosed which includes a bottom section and a rim, the rim comprising a plurality of circumferentially spaced resilient fingers extending at a slight incline outwardly from the axis of the pot-like hub away from the bottom section, the fingers having inner surfaces facing the axis and outer surfaces facing away from the axis, and an electrically conductive resilient loop spring comprising a first end, a second end and an arcuate intermediate section between the first end and the second end, the first end extending outwardly away from the axis past beyond the outer surfaces of adjacent fingers, the arcuate intermediate section extending around the inner surfaces of the fingers to form an arc in pressure contact with the inner surface of the fingers and the second end is adjacent the axis. This hub is utilized in a drum assembly comprising a hollow cylindrical drum comprising an electrically conductive substrate and an electrically conductive shaft positioned along the axis of the drum. This assembly may be fabricated by installing the hub in one end of a drum along with an electrically conductive resilient loop spring.

12 Claims, 1 Drawing Sheet

SEGMENTED END BELL

BACKGROUND OF THE INVENTION

This invention relates in general to drum support apparatus and more specifically to an improved drum supporting hub and a drum assembly including the hub.

It is generally recognized in the art that photoreceptor drum slippage between an imaging drum supporting hub and the drum it supports can significantly affect copy quality. As known in the art a uniformly charged photoreceptor coated drum is illuminated in image configuration to form an electrostatic latent image on the drum. The drum bearing the image is rotated through a developing station containing toner particles which are attracted to and deposited on the photoconductor coating in image configuration. The resulting toner image is then electrostatically transferred to a receiving sheet. The receiving-sheet bearing the toner image is then removed from the drum and transported through a fuser which fixes the toner image to the receiving sheet. Any residual toner is thereafter cleaned from the photoreceptor surface. Thus, the imaging cycle involves uniform charging, imagewise discharging, developing, transfer, and cleaning. The drum and other components of the imaging system must be synchronized to ensure quality images. The drum is driven by torque applied to the hub by means of a gear or pulley attached to the hub or shaft on which the hub is attached. For economic or space saving reasons, torque may be applied to a hub at one end of a drum and the drum itself transfers at least some of the torque to other devices by means of a gear or pulley secured to a hub at the opposite end of the drum. In addition, resistance to rotation of the drum may be generated by developer applicators, cleaning blades or brushes and the like in contact with the drum. Thus, if slippage occurs during the imaging process, it is impossible to maintain consistently high copy quality in modern, highly synchronized electrostatographic imaging systems.

A photoreceptor conventionally utilized for copiers and printers comprises a hollow electrically conductive drum substrate which has been dip coated with various coatings including at least one photoconductive coating comprising pigment particles dispersed in a film-forming binder. These drum type photoreceptors are usually supported on an electrically conductive shaft by drum supporting hubs or end flanges. The hubs are usually constructed of plastic material and have a hole through their center into which a supporting axle shaft is inserted. Since hubs are usually constructed of electrically insulating plastic material, an electrical grounding means comprising a flexible spring steel metal strip is secured to the hub and positioned to contact both the electrically conductive axle shaft and the electrically conductive metal substrate of the photoreceptor drum. One type of grounding means is illustrated in U.S. Pat. No. 4,561,763. However, these grounding means are molded or other wise attached to the side of the hub that faces the interior of the drum. Thus, when the hub is mounted in an end of the drum, the grounding means cannot be readily seen when a support shaft is inserted through the hub and drum. Thus, the grounding means can occasionally be damaged by bending when the shaft is installed. Damaged grounding strips can cause loss of electrical ground during installation of the shaft or can lead to premature failure during image cycling. Also, sufficient contact pressure between the grounding strip and the shaft or substrate is difficult to achieve. Thus, to achieve as much contact pressure as possible between the resilient plastic hub fingers and the adjacent drum substrate, expensive plastic materials are employed. Although excellent drum support is provided by these hubs, slippage between the hub and the drum substrate can still occur under high torque conditions where considerable friction is imposed on the surface of the photoreceptor by contact with subsystems such as cleaning blades and the like or where the flange on the opposite end of the photoreceptor drum is utilized to drive other copier or printer components.

Often the hub or end flange is secured to the end of the drum by a thermosetting resin adhesive. The use of an adhesive increases the number of steps and complexity of equipment required to assemble and disassemble a hub and cylindrical member assembly. Recycling of used drums having glued hubs is difficult, if not impossible, because of damage to the hub or the drum or both during removal of the hub from the drum by common techniques such as by hammering. Such removal techniques damage or destroy both the drum and the hub. Further, where disassembly is accomplished without damage, cleaning of both the hub and the cylindrical substrate is required to remove adhering adhesive. In addition, adhesive application equipment utilized during mounting of an end flange to a cylindrical substrate are difficult to maintain because the adhesive has a short pot life and often solidifies and clogs the equipment thereby requiring time consuming efforts to clean and remove the solidified adhesive. The use of bolts and nuts to secure hubs to drums requires time intensive activity.

Another type of hub avoids the need for an adhesive by utilizing resilient fingers having pointed tips that dig into and penetrate the inner surface of the drum. This hub is described in U.S. Pat. No. 5,357,321, the entire disclosure thereof being incorporated herein by reference. The hub provides excellent support for the drum. However, the pointed tips can form scratches and grooves in the interior surface of the drum during installation, use and removal. These scratches or grooves can adversely affect recycling of the cylindrical substrate. For example, in processes for dip coating a hollow cylindrical substrate such as a drum, the substrate is immersed in a coating solution by vertically moving the substrate in a direction parallel to the axis of the substrate. To avoid coating the interior of the hollow substrate, an expandable mandrel is usually employed to grip and seal off the upper end of the drum during the immersion coating process. Sealing of the upper end of the cylindrical substrate traps air within the interior of the cylindrical substrate below the mandrel during the coating operation thereby preventing any significant entry and deposition of the coating material within the hollow interior of the cylindrical substrate during the dip coating operation. However, scratches or grooves in the upper end of the interior of the cylindrical substrate interferes with the establishment of an airtight seal thereby allowing air to leak out from the interior of the cylindrical substrate past the mandrel seal. This allows undesirable entry and deposition of the coating material within the interior of the cylindrical substrate during dip coating operations. Also, the pointed tips provide a limited number of gripping points to secure the hub to the periphery of a hollow drum for high torque situations.

INFORMATION DISCLOSURE STATEMENT

U.S. Pat. No. 4,561,763 issued to D. Basch issued on Dec. 31, 1985 a drum supporting hub is disclosed having a tapered pot-like hub configuration comprising a bottom section and a rim, the rim comprising a plurality of circumferentially spaced resilient fingers extending at a slight incline outwardly from the axis of the pot-like hub away from the bottom section, at least three of the fingers having lips at the ends of the fingers, the lips projecting away from the axis for engagement with an end of a cylindrical drum upon insertion of the pot-like hub into the drum, the rim other than the lips having an outside diameter slightly larger than the outside diameter of the bottom. The drum supporting hub is employed in a drum assembly comprising the hub, a cylindrical drum having a circular cross-section and a shaft positioned along the axis of the drum. A metal shim is utilized to electrically ground the drum to the shaft.

U.S. Pat. No. 5,357,321 issued to Stenzel et al on Oct. 18, 1994—A drum supporting hub is disclosed comprising a disk shaped member having a circular periphery, a hole extending axially through the center of the disk shaped member, and at least one long thin electrically conductive resilient member secured to the disk shaped member, the resilient member having a central section adjacent the hole and having opposite ends, each of the ends terminating into at least one pointed tip adjacent the circular periphery of the disk shaped member, and the resilient member having a major plane substantially parallel to the axis of the disk shaped member. This hub may be inserted in at least one end of a cylindrical electrostatographic imaging member to produce an imaging member assembly.

Thus, there is a continuing need for improved photoreceptors that are simpler to mount and remove, which can endure high torque applications and which provide highly reliable electrical grounding.

SUMMARY OF THE INVENTION

It is, therefore, an object of the present invention to provide an improved drum supporting hub and drum assembly which overcomes the above-noted disadvantages.

It is yet another object of the present invention to provide a drum supporting hub facilitates recycling of end flanges and hollow cylindrical members.

A further object of the present invention is to provide an improved drum supporting hub and hollow drum assembly which reduces the number of assembly steps utilized to manufacture the assembly.

It is still another object of the present invention to provide a drum supporting hub which resists distortion.

It is another object of the present invention to provide a drum supporting hub which imparts self-centering characteristics to drums.

It is yet another object of the present invention to provide a drum supporting hub which is light in weight.

It is still another object of this invention to provide an improved drum supporting hub and hollow drum assembly which eliminates the need for gluing an end flange to the end of a hollow drum.

It is another object of this invention to provide an improved supporting hub and hollow drum assembly which resists slippage under high torque applications.

It is yet another object of the present invention to provide a drum supporting hub which more readily facilitates installation of a grounding means.

It is still another object of this invention to provide an improved drum supporting hub and hollow drum assembly which can avoid scratching the internal surface of a hollow drum.

The foregoing and other objects of the present invention are accomplished by providing a tapered pot-like hub comprising a bottom section and a rim, the rim comprising a plurality of circumferentially spaced resilient fingers extending at a slight incline outwardly from the axis of the pot-like hub away from the bottom section, the fingers having inner surfaces facing the axis and outer surfaces facing away from the axis, and an electrically conductive resilient loop spring comprising a first end, a second end and an arcuate intermediate section between the first end and the second end, the first end extending outwardly away from the axis past beyond the outer surfaces of adjacent fingers, the arcuate intermediate section extending around the inner surfaces of the fingers to form an arc in pressure contact with the inner surface of the fingers and the second end is adjacent the axis. This hub is utilized in a drum assembly comprising a hollow cylindrical drum comprising an electrically conductive substrate and an electrically conductive shaft positioned along the axis of the drum. This assembly may be fabricated by installing the hub in one end of a drum along with an electrically conductive resilient loop spring.

BRIEF DESCRIPTION OF THE DRAWINGS

In general, the advantages of the improved drum supporting hub and drum assembly will become apparent upon consideration of the following disclosure of the invention, particularly when taken in conjunction with the accompanying drawings wherein.

These figures merely schematically illustrate the invention and are not intended to indicate relative size and dimensions of actual devices and components thereof.

DETAILED DESCRIPTION OF THE DRAWINGS

The present invention may be employed in any suitable device that requires support for a drum. However, for purposes of illustration, the invention will be described with reference to an electrophotographic imaging system. A typical electrophotographic imaging system is illustrated in U.S. Pat. No. 3,900,258 to R. F. Hoppner et al, the entire disclosure thereof incorporated herein by reference.

Figure 1:
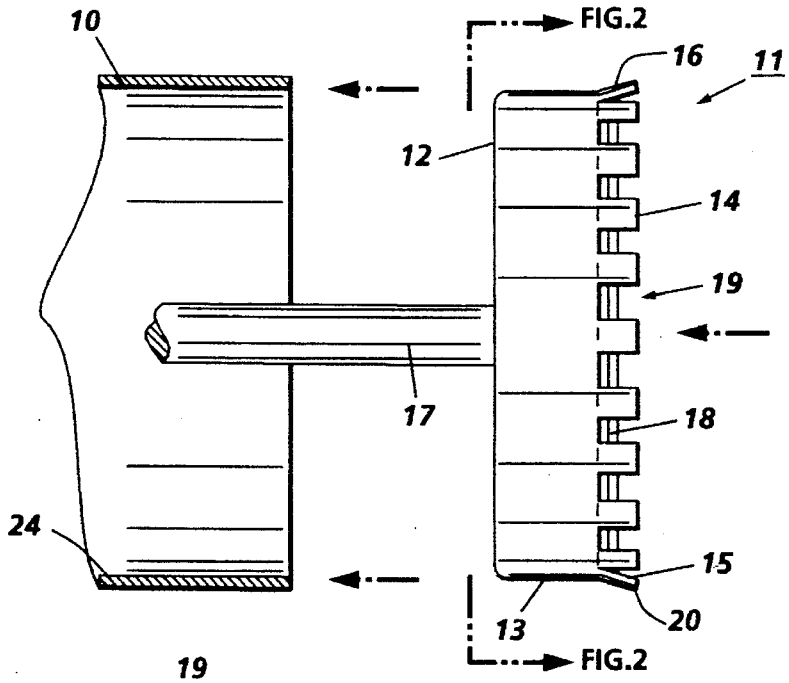
FIG. 1 is a partial, schematic side view of a drum supporting hub being installed in one end of a drum to form a drum assembly of the instant invention.

Referring to FIG. 1, the fabrication of a hollow cylindrical drum assembly is illustrated in which a hollow cylindrical drum 10 having a circular cross-section receives, at one end, a tapered pot-like drum supporting hub 11 comprising a bottom cup-like section 12 having an annular ring 13 and a plurality of circumferentially spaced resilient fingers 14 extending from annular ring 13 of cup-like section 12 at a slight incline outwardly from the axis of the hub 11 away from the annular ring 13 so that, taken collectively, the resilient fingers 14 form a slightly flared rim opening for the generally pot shaped drum supporting hub 11. The annular ring 13 should have an outside diameter less than the inside diameter of cylindrical drum 10 to permit insertion of the drum supporting hub 11 into cylindrical drum 12 without undue frictional interference. Fingers 14 have inner surfaces 15 facing the hub axis and outer surfaces 16 facing away from the hub axis. A shaft 17 extends along the common axis of drum 10 and hub 11. Each resilient finger 14 has an arcuate cross-section (when viewed in a direction parallel to the axis of the drum). Prior to insertion of drum supporting hub 11 into an end of cylindrical drum 10, an imaginary circle drawn around the outer surfaces 16 at points farthest from bottom section 12 will have a diameter slightly larger than the inside diameter of cylindrical drum 10. Thus, when drum supporting hub 11 is inserted into an end of cylindrical drum 10, the fingers 14 are compressed toward the shaft 17 to snugly fit into the end of cylindrical drum 10. The outer surfaces 16 of fingers 14 are preferably shaped so that the entire rim outer surface contacts and is contiguous with the inner surface 24 of cylindrical drum 10 when the fingers 14 are compressed after insertion of the supporting hub 11 into an end of cylindrical drum 10. The large outer surface area of the rim formed from the outer surfaces 16 of fingers 14 in contact with the inner surface of cylindrical drum 10 forms a supporting band which maintains the roundness of cylindrical drum 10 and provides a friction fit which prevents the supporting hub 11 from falling out of the end of cylindrical drum 10 during handling. The large outer surface area of the rim surface in contiguous contact with the inner surface 24 of the cylindrical drum 10 also distributes the pressure from each compressed finger 14 over a greater area of the inner surface 24 of the cylindrical drum 10 thereby minimizing distortion of the drum 10 particularly in regions occupied by the slots. The outer rim surface is normally not parallel to the inner surface 24 of the cylindrical drum 10 prior to compression of the fingers 14. However, the outer rim surface assumes a position parallel to the inner surface 24 of the cylindrical drum 10 after it is fully inserted into an end of cylindrical drum 10. The outer rim Surface is parallel as well as in contact with the inner surface 24 of drum 10. This results in a contact ring or contact band which may be completely around (minus the area corresponding to the slots) the inner periphery of the cylindrical drum 10. The width of the outer rim surface depends on the resiliency of the cylindrical drum 10. Thus, line contact is adequate for a stiff, thick drum. Flexible drums require a contact ring or contact band of sufficient width to prevent distortion at the end of the drum 10 and to resist drum flexing during use. For example, a contact ring or band 0.5 inch (1.27 centimeters) wide provides excellent support for thin electroformed nickel drums having a thickness of about 152 micrometers, a diameter of about 8.35 centimeters and a length of about 40 centimeters. An intermediate arcuate section 18 of a resilient metallic G-shaped loop spring 19 (see FIG. 3) extends, in the shape of a partial circular arc of at least about 270 degrees, around the inner surfaces 15 of most of the fingers 14. This intermediate arcuate section 18 is in pressure contact with the inner surfaces 15 of fingers 14 thereby biasing the fingers 14 away from the axis of hub 11. Hub 11 is similar to the hub disclosed in U.S. Pat. No. 4,561,763, the entire disclosure thereof being incorporated herein by reference. Some distinguishing features between the hub described in U.S. Pat. No. 4,562,763 and the hub of this invention include the presence of a novel of electrically conductive metallic band in the hub of this invention, means for retaining the band on the hub, nature of access to the band, and improved resistance against slippage between the hub and drum when torque is applied to the hub and/or drum. Prior to actual insertion of the tapered pot-like drum supporting hub 11 into the interior of drum 10, the configuration of fingers 14 should be such that an imaginary circle connecting the outer surfaces 16 at the very tips 20 of fingers 14 has a diameter larger than the inside diameter of drum 10. If desired, the outer tips of some or all of the flexible fingers 14 may have lips (not shown) extending radially outward away from the axis of the hub to function as a stop which abuts against the end of the cylindrical drum 10 to assist in positioning of drum supporting hub 11 in cylindrical drum 10. Preferably, the height of the lip is flush with the outer surface of cylindrical drum 10 when the drum supporting hub 11 is fully inserted into cylindrical drum 10. The optional lips are described in detail in U.S. Pat. No. 4,562,763. The drum supporting hub 11 should comprise at least 3 resilient fingers 14 to maintain the cylindrical shape of cylindrical drum 10. Generally, the number of fingers desired depends to some extent upon the thickness, flexibility of cylindrical drum 10, stiffness of resilient metallic G-shaped loop spring 19 and the resiliency of each finger. Thus, with a thick, more rigid, cylindrical drum 10, fewer fingers are necessary to maintain roundness. However, fewer fingers result in an increased potential for out-of-roundness to occur in thin drums due to a decreased capability for maintaining a true radial arc corresponding to the internal perimeter of the cylinder. Generally, for any given finger thickness, an increase in the number of resilient fingers 16 also reduces the degree of friction fit of drum supporting hub 11 in the end of cylindrical drum 10. The stiffness of the resilient finger 16 may be altered by appropriate selection of materials and finger length, width, and thickness. Depending on the stiffness of resilient fingers 16, stiffness of loop spring 19 and the flexibility of cylindrical drum 10, the width of the fingers may vary one from each other. However, the variations should not be so great as to distort the roundness of the cylindrical drum 10. Similarly, the width of the slots between the resilient fingers 14 should be sufficiently small to avoid distortion of cylindrical drum 10. If the slot is unduly wide, a depression can form on the outer surface of a thin cylindrical drum 10 in the region above the slot. Similarly, the slot should be sufficiently wide to permit adequate compression of the resilient fingers 14 during insertion of the supporting hub 11 into the end of cylindrical drum 10. Although the slots may be of minimal width so that the sides of adjacent resilient fingers 14 contact each other when compressed during insertion into an end of cylindrical drum 10, slightly wider slots are acceptable so long as significant distortion of the outer surface of the cylindrical drum 10 is avoided. A slot width of about 0.05 inches (1.27 millimeters) is a typical example of a slot width that provides acceptable support for an electroformed nickel drum and which can also be readily injection molded. Wide slots are acceptable for thick stiff drums 10. Although not shown in FIG. 1, the slot length may, if desired, extend to or even partially into the bottom of the supporting hub 11. The slots should at least extend from the end or near the end of each finger to a point sufficiently beyond the rim surface to allow the rim surface to assume a position parallel to and in contact with the inner surface of the cylindrical drum 10 after the fingers 14 are compressed and fully inserted into an end of cylindrical drum 10 thereby providing a firm, circular, shape retaining support for the inner surface 24 of cylindrical drum 10. The slots may be of any suitable shape. For example, the slots may have parallel sides or a taper to facilitate removal from a mold. The drum supporting hub 11 should contain at least 3 slots to maintain the cylindrical shape of cylindrical drum 10. It should be noted that 3 slots will inherently form 3 resilient fingers 14. The inner tips of resilient fingers 14 may be provided with a beveled fingertip surface (not shown) which collectively form a surface which functions as self centering surface for the cylindrical drum about shaft 17 when an optional beveled end plate surface of an end plate (not shown) is pressed against and seated on the beveled fingertip surface of drum supporting hub 11. End plates are known in the prior art and described in detail in U.S. Pat. No. 4,562,763. Any suitable conventional means (not shown) may be employed to seat end plates against the drum supporting hubs 11. Typical seating means include tie rods as illustrated, for example, in U.S. Pat. No. 3,994,053 to Hunt and threaded shafts such as illustrated in U.S. Pat. No. 4,120,576 to Babish, the entire disclosures of these patents being incorporated herein by reference.

Figure 2:
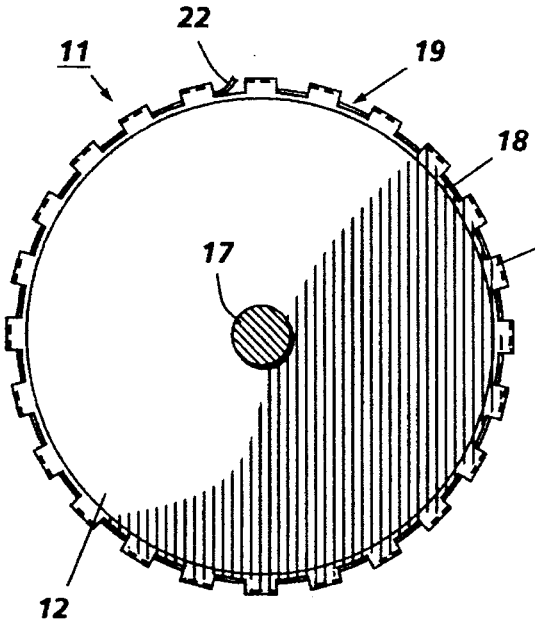
FIG. 2 is a partial, schematic, end view of a hub of the instant invention taken in the direction shown in FIG. 1.

Shown in FIG. 2 is a view taken in the direction shown by the arrows FIG. 2—FIG. 2 in FIG. 1. This view more clearly illustrates the partial circular arc shape of intermediate arcuate section 18 contacting the inner surfaces 16 (see FIGS. 1 and 3) of most of fingers 14. Also discernible is the first end 22 of resilient metallic G-shaped loop spring 19 extending from intermediate section 18 outwardly away from the axis of hub 11 beyond the outer surfaces of a pair of adjacent fingers 14. Extension of first end 22 beyond the outer surfaces 16 of a pair of adjacent fingers 14, ensures that first end 22 maintains firm pressure contact with the inner surface of drum 10 after installation of the resilient electrically conductive metallic band. Although the resilient electrically conductive metallic band is illustrated in FIG. 2 as installed in hub 11 prior to installation of hub 11 into drum 10, hub 10 may instead be installed into at least one end of drum 10 prior to installation of band 19 into hub 11. This latter installation technique is preferred because loop spring 19 may be installed while maintaining first end 22 out of contact until the rest of loop spring 19 is seated in hub 11. Second end is thereafter gently lowered into contact with the inner surface 24 of drum 10 to avoid skidding of first end 22 over the inner surface 24 during installation. A reverse sequence of steps may be used to remove loop spring 19 and hub 11 from the end of drum 10. More specifically, first end 22 can be lifted toward the axis of hub 11 to move first end 22 out of contact with inner surface 24 of drum 10 prior to removing loop spring 19 from hub 11. Following removal of loop spring 19 from hub 11, hub 11 may be removed from drum 10. This removal sequence also avoids the skidding of first end 22 over the inner surface 24 during removal. Avoidance of skidding prevents undesirable scratches or gouges from forming in the inner surface 24 of drum 10. The manipulation of loop spring 19 during installation and removal may be accomplished manually by hand, by robot or by any other suitable means.

Figure 3:
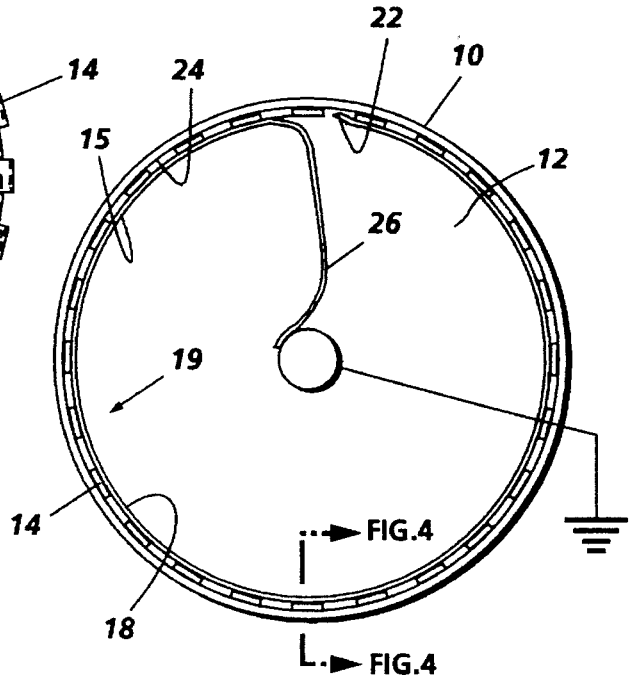
FIG. 3 is a partial, schematic, end view of the opposite side of the hub illustrated in FIG. 2 after the hub is installed in one end of a drum.

Referring to FIG. 3, an end view is illustrated of hub 11 and loop spring 19 installed in one end of drum 10. The outer surfaces 16 of fingers 14 are in pressure contact with the inner surface 24 of drum 10. The compressive contact exerted on inner surface 24 by outer surfaces 16 of fingers 14 is intensified by compressive pressure applied by intermediate arcuate section 18 of loop spring 19 against the inner surfaces 15 of most of fingers 14. Since both fingers 14 and intermediate section 18 of resilient metallic G-shaped loop spring 19 exert a combined compressive pressure in a radial direction away from the axis of hub 11, the combined compressive pressure greatly increases the friction between the outer surfaces of fingers 14 and inner surface 24 of drum 10 to provide significantly greater resistance to slippage between hub 11 and drum 10 when torque is applied to hub 11 and/or drum 10. The second end 26 of loop spring 19 is in pressure contact with electrically grounded shaft 17. G-shaped loop spring 19 is constructed so that when it is installed in hub 11, the entire spring 19 is biased to uncoil. Thus, intermediate arcuate section 18 is disposed to uncoil thereby applying compressive pressure in a radial direction onto inner surface 15 of fingers 14 and first end 22 is disposed to press against inner surface 24 and second end 26 is disposed to press against shaft 17.

Figure 4:
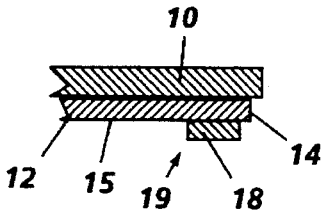
FIG. 4 is a partial, schematic, sectional side view of a hub and drum assembly of the instant invention taken in the direction shown in FIG. 3.

Illustrated in FIG. 4 is a view taken in the direction FIG. 4—FIG. 4 shown in FIG. 3. Arcuate intermediate section 18 of loop spring 19 is relatively flat and has a rectangular cross section with a flat surface in contact with the inner surfaces 15 of fingers 14 to resist shifting on the fingers 14 after loop spring 19 and bottom cup-like section 12 have been installed in one end of drum 10.

Figure 5:
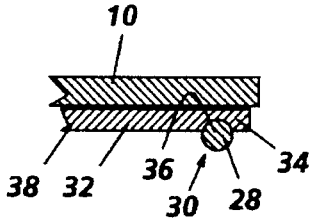
FIG. 5 is a partial, schematic, sectional side view of an alternative hub and drum assembly of the instant invention.

Shown in FIG. 5 is another embodiment of this invention in which an arcuate intermediate section 28 of loop spring 30 has a circular cross section and the inner surface 32 of fingers 34 have a detention groove 36 perpendicular to the axis of bottom cup-like section 38. Groove 36 functions as a cradle to ensure consistent positioning of arcuate intermediate section 28 on the inner surface 32 of fingers 34 to ensure that intermediate section 28 does not shift. Although groove 36 has a cross sectional shape of a half circle in FIG. 5, it may be of any other suitable shape such as rectangular, triangular, oval (not shown) or the like to cradle an arcuate intermediate section of a loop spring.

Preferably, the G-shaped loop spring comprises a metal having hard spring-like properties. Typical hard spring-like metals include, for example, steel, stainless steel, copper beryllium alloy, phosphorous bronze and the like or conductive plastic: The loop spring should have an electrical resistivity of less than about 1,000 ohm-cm. The specific material and length, width, and thickness selected for the loop spring affect the resiliency of the loop spring. The width, thickness and resiliency should be sufficient to resist permanent deformation and to retain the hub in position at least at one end of hollow cylindrical member.

A loop spring of this invention preferably has an intermediate arcuate section of at least about 270 degrees of the exposed periphery available for contact with the inner surfaces of the circumferentially spaced resilient fingers to enhance retention of the hub on the end of the hollow cylindrical drum, resist slippage and to avoid distortion of the drum, particularly thin flexible drums. The spring material should be self supporting, be disposed to uncoil when compressed and resist permanent distortion.

The cylindrical drum 10 and drum supporting hub 11 may comprise any suitable organic or inorganic material. Typical organic materials include polyester resins, polypropylene resins, epoxy resins, polycarbonate resins, polystyrene resins and the like. Typical inorganic materials include metals and alloys thereof such as aluminum, nickel, brass, and the like. The cylindrical drum 10 and drum supporting hub 11 may comprise a homogeneous composition or a composite composition and may be electrically conductive or electrically insulating. Moreover, the cylindrical drum 10 and drum supporting hub 11 may be rendered electrically conductive by fabrication of the hub with metals or synthetic plastics containing dispersed conductive particles such as metal flakes or carbon; or coated with an electrically conductive coating such as carbon black dispersed in a resin or vacuum deposited metals such as aluminum. The cylindrical drum 10 and drum supporting hub 11 illustrated in FIG. 1 may be electrically insulating with electrical grounding of the drum to shaft 17 being achieved through resilient electrically conductive metallic G-shaped loop spring 19.

The bottom cup-like section 12 of drum supporting hub 11 may be provided with a shaped hole such as a square hole (not shown) to accommodate a shaft having a corresponding square cross sectional shape so that hub 11 rotates when shaft 17 is rotated. Obviously, any other suitable means may be substituted such as flat region in the shaft cross section and a hole with a matching shape. Other typical alternative means include, for example, hexagonal shafts with a correspondingly shaped opening in the hub which mated with periphery of the shaft or a collar and set screw may be fastened to the hub.

Although, the drum assemblies illustrated in the drawings show a drum supporting hub at one end of the drum the same or different hub may be installed at the other end of the drum. The drum supporting hub of this invention may be employed with relatively thick cylindrical drums. The hubs are also suitable for thin electroformed flexible drums. Moreover, the flexible finger arrangement is more forgiving for variations in tolerance of the inside diameter of photoreceptor drums. Generally, the drums should have a thickness sufficient to prevent distortion in the slotted regions of the drum supporting hub. The thickness of the drums should also be sufficient to support the drum shape over the length of the drum whereby the outer surface of the drum remains parallel to the axis of the shaft. Therefore, as length and diameter increase, the thickness of the drum should be increased to maintain sufficient rigidity of the assembly.

The invention has been described in detail with particular reference to preferred embodiments thereof but it will be understood that variations and modifications can be effected within the spirit and scope of the invention as described herein above and as defined in the appended claims.

What is claimed is:

1. A tapered pot-like hub comprising a bottom section and a rim sharing a common axis, said rim comprising a plurality of circumferentially spaced resilient fingers extending at a slight incline outwardly from said axis away from the bottom section, said fingers having inner surfaces facing said axis and outer surfaces facing away from said axis, and an electrically conductive resilient loop spring comprising a first end, a second end and an arcuate intermediate section between said first end and said second end, said first end extending outwardly away from said axis between adjacent spaced resilient fingers past said outer surfaces of adjacent fingers, said arcuate intermediate section extending around said inner surfaces of said fingers to form an arc in pressure contact with said inner surface of said fingers and said second end is adjacent said axis for contact with a shaft to be inserted along said axis.

2. A tapered pot-like hub according to claim 1 wherein said arcuate intermediate section extends around said inner surfaces of said fingers in an arc of between about 270 degrees and about 360 degrees.

3. A tapered pot-like hub according to claim 1 wherein said resilient loop spring has a G-shape.

4. A tapered pot-like hub according to claim 1 wherein said resilient loop spring has a circular cross section.

5. A tapered pot-like hub according to claim 1 wherein said resilient loop spring has a rectangular cross section.

6. A tapered pot-like hub according to claim 1 wherein said inner surfaces of said fingers comprise a detention groove to cradle said arcuate intermediate section of said loop spring.

7. A drum assembly according to claim 2 wherein said arcuate intermediate section extending around said inner surfaces of said fingers forms an arc of between about 270 degrees and about 360 degrees.

8. A drum assembly according to claim 7 wherein said resilient loop spring has a G-shape.

9. A drum assembly according to claim 7 wherein said resilient loop spring has a circular cross section.

10. A drum assembly according to claim 7 wherein said resilient loop spring has a rectangular cross section.

11. A drum assembly according to claim 7 wherein said inner surfaces of said fingers comprise a detention groove to cradle said arcuate intermediate section of said loop spring.

12. A drum assembly comprising a hollow cylindrical drum having a circular cross-section, an axis and an electrically conductive substrate having an inner surface, an electrically conductive shaft positioned along said axis of said drum and a least one self-centering, tapered pot-like drum supporting hub on said shaft at one end of said drum, said hub comprising a bottom cup section and a rim, said rim comprising a plurality of circumferentially spaced resilient fingers extending at a slight incline outwardly from said axis of said pot-like hub away from said bottom section, said fingers having inner surfaces facing said axis and outer surfaces facing away from said axis, said outer surfaces of said spaced fingers being in pressure contact with said inner surface of said drum, and an electrically conductive resilient loop spring comprising a first end, a second end and an arcuate intermediate section between said first end and said second end, said first end extending outwardly away from said axis between adjacent spaced resilient fingers past the outer surfaces of said adjacent spaced resilient fingers into pressure contact with said inner surface, said arcuate intermediate section extending around said inner surfaces of said fingers to form an arc in pressure contact with said inner surface of said fingers and said second end in pressure contact with said shaft to provide an electrical path between said shaft and said substrate.

* * * * *